United States Patent [19]

Piersol

[11] 4,002,527

[45] Jan. 11, 1977

[54] SOLVENT-DISTRIBUTED, POWDERED RUBBER IN BEATER SATURATED SHEETS

[75] Inventor: Jay L. Piersol, Lancaster, Pa.

[73] Assignee: Armstrong Cork Company, Lancaster, Pa.

[22] Filed: Apr. 3, 1975

[21] Appl. No.: 564,883

Related U.S. Application Data

[63] Continuation-in-part of Ser. No. 375,496, July 2, 1973, abandoned.

[52] U.S. Cl. ..... 162/155; 162/169; 162/184

[51] Int. Cl.[2] ..... D21F 11/00

[58] Field of Search ..... 162/170, 169, 183, 184, 162/145, 155; 428/495, 537

[56] References Cited

UNITED STATES PATENTS

| | | | |
|---|---|---|---|
| 1,904,087 | 4/1933 | Schacht | 162/170 |
| 3,102,837 | 9/1963 | Griswold | 162/170 |
| 3,344,017 | 9/1907 | Lesniak | 162/169 |

FOREIGN PATENTS OR APPLICATIONS

| | | | |
|---|---|---|---|
| 764,103 | 12/1956 | United Kingdom | 162/159 |

OTHER PUBLICATIONS

Casey, "Pulp & Paper," vol. II, (1960), p. 947.

Hawley, "The Condensed Chem. Dictionary," 8th Ed., (1971), p. 766.

*Primary Examiner*—S. Leon Bashore

*Assistant Examiner*—Peter Chin

[57] ABSTRACT

A beater saturation process wherein a fine powdered chlorinated natural rubber is added to papermaking fibers suspended in water. A synthetic binder in latex form is precipitated onto the fibers carrying with it the fine powdered rubber particles. This slurry is formed into a dry sheet and treated with a solvent which partially dissolves or substantially swells the chlorinated natural rubber but which does not so dissolve the synthetic latex binder. The chlorinated natural rubber is thus further distributed and smeared throughout the sheet by the solvent. The solvent is removed and a stiff strong sheet results.

9 Claims, 3 Drawing Figures

Fig 1
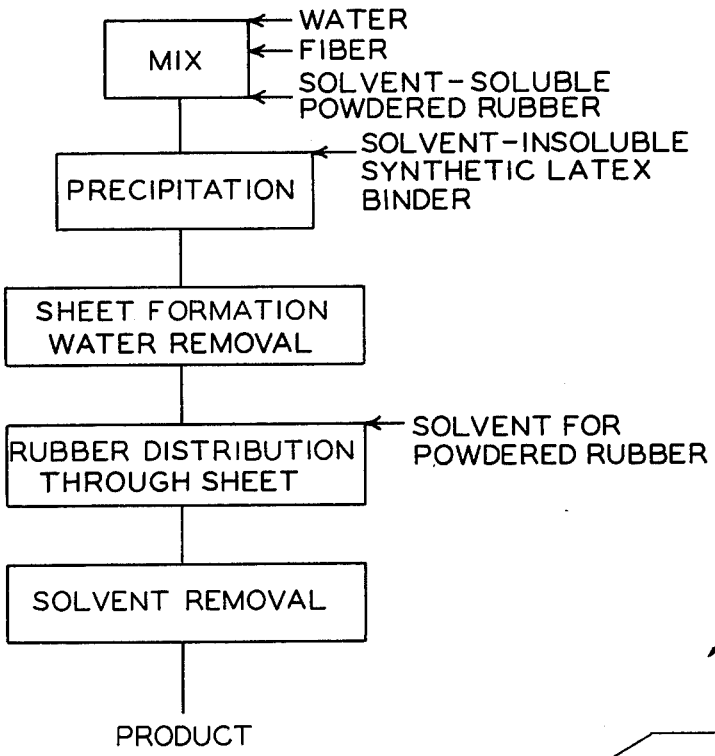
Fig 2
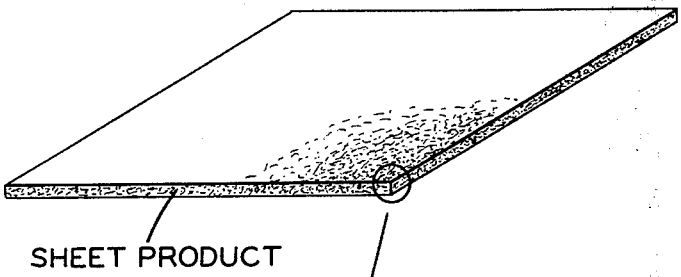
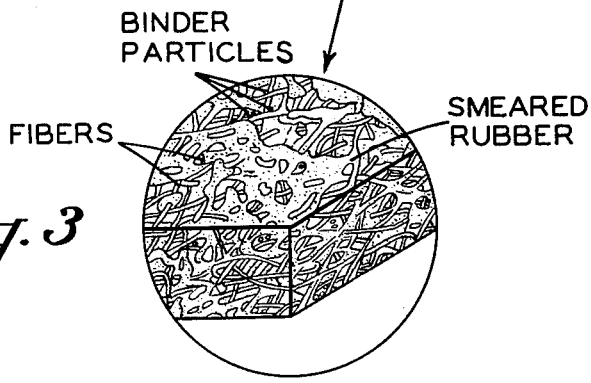
Fig. 3

SOLVENT-DISTRIBUTED, POWDERED RUBBER IN BEATER SATURATED SHEETS

CROSS-REFERENCE TO RELATED APPLICATION

This application is a continuation-in-part of Applicant's United States application, Ser. No. 375,496, filed July 2, 1973, and now abandoned, entitled "Solvent-Distributed, Powdered Rubber In Beater Saturated Sheets".

BACKGROUND OF THE INVENTION

1. Field of the Invention

The invention relates generally to beater saturation processes wherein a particular powdered rubber is deposited on fibers along with certain synthetic binders.

2. Description of the Prior Art

U.S. Pat. No. 1,926,028-Boughton describes a process of mixing rubber particles and fibers in a water slurry and forming a sheet from the mixture. After drying, the fiber-rubber sheet is treated with a solvent for the rubber in order that the rubber will be softened by the solvent and distributed among the fibers in order to adhere better to those fibers.

U.S. Pat. No. 1,787,952-Richter et al teaches the formation of a leather substitute by impregnating bibulous webs of interfelted cellulose fibers, such as those composed of wood pulp, with an aqueous rubber dispersion and then passing the web through a bath of rubber solvent such as benzol, whereupon a swelling of the rubber takes place.

SUMMARY OF THE INVENTION

The invention comprises adding to a slurry of fibers in water, a powdered chlorinated natural rubber and agitating the mixture to maintain the powdered rubber in dispersed form. The powdered chlorinated natural rubber is easily swellable by a rubber solvent to be used in a subsequent step. A synthetic latex binder is next added and precipitated on said fibers. The binder in the latex is either insoluble or only difficulty swellable by the solvent to be used in the subsequent step. The powdered rubber is swept with the binder to the fibers. The binder holds the powdered rubber on the fibers. A sheet is formed from the rubber-coated fibers. After removal of the water, the sheet is treated with a solvent which strongly swells the chlorinated natural rubber but which does not so swell the binder. Only by use of such a non-swelling binder will the fibers be held together in sheet form while the solvent is strongly swelling and smearing the chlorinated natural rubber. This solvent treatment serves to smear the chlorinated natural rubber throughout the sheet. Solvent is then removed. The resulting sheet is sufficiently strong, water resistant, and stable that it may be formed into fill for cooling towers.

BRIEF DESCRIPTION OF THE DRAWING

FIG. 1 is a flow diagram of the process of the present invention;

FIG. 2 is a simplified three-dimensional representation of a sheet made by the present invention; and FIG. 3 represents an enlarged section of FIG. 2 showing in general form details of the fibrous structure of the product.

DESCRIPTION OF THE PREFERRED EMBODIMENTS

The fibers to be used in the process of the present invention may be any of those fibers customarily used in the beater saturation processes, except snythetic fibers. Examples of usable fibers are asbestos, kraft, sulphite, cotton linters, and animal fibers such as wool. These fibers will be handled in the usual manner. They will be slurried in water to the usual consistency of beater saturation processes, normally in the range of 0.5% -3% by weight fibers in the slurry. Cellulosic fibers, asbestos fibers, and certain other fibers will normally be subjected to beating or other mechanical refining treatment in accordance with normal processes in order that the Canadian 3-gram freeness of the slurry will be in the range of about 100–600 cc's. Although beating will normally be the way the fibers are pretreated, other refining apparatus may be used such as disc refiners, Jordan engines, and the like.

After forming the slurry in the desired consistency and after any mechanical refining, the slurry will be subjected to any of the normal processes customarily used in the beater saturation of such fibers. The so-called alum-ammonia process may be used as set forth in U.S. Pat. No. 2,375,244-Pretzel. For asbestos fibers, the citric acid process may be used as set forth in U.S. Pat. No. 2,759,813-Feigley.

The next step will be the addition to the refined and pretreated slurry the chlorinated natural rubber in a fine or powdered form. The powdered rubber will simply be added by mixing the dry powder with the fibrous slurry, with sufficient agitation to maintain the powdered rubber in suspension with the fibers in the slurry. At this point in the process, the powdered rubber is present simply as a mechanically dispersed powder in the slurry.

The chlorinated natural rubber is an item of commerce available in powdered form in a variety of viscosities as determined in a 20% concentration in toluene. The specific volume of the material will generally average around 70 cubic inches per pound. It is soluble in toluene, xylene, aromatic hydrocarbon, esters, ketones, and some other commercially used solvents. It is used in the present process in the form of the white granular powder just as it is made and sold. Particle size is as follows: at least 95% passing a No. 20 sieve, 40% to 90% passing a No.180 sieve, and 40% passing a No. 325 sieve, the percentage being by weight of the original mass of particles and the sieves being of the Standard Screen Series, U.S. Bureau of Standards, 1919.

The powdered rubber is made by chlorinating a natural rubber to incorporate into the rubber an amount of chlorine of about 50%–70% by weight. Such rubber has particular utility for the use intended by the product of the present invention since it is readily solvent-soluble in certain commercial solvents, is highly fire resistant and, when distributed throughout the final sheet, lends itself to the formation of shaped cooling tower fill materials in corrugated and saddle form. The amount of the chlorinated natural rubber in powdered form to be added to the slurry will be about 25% by weight of rubber based on the dry weight of the fibers.

The next step in the process will be the addition of a synthetic latex to the slurry containing the dispersed powdered rubber. The synthetic latices to be used in the present process may be any of the latices customarily used in beater saturation processes, with the proviso that they must be substantially insoluble in the solvent to be subsequently used to strongly swell and smear the chlorinated natural rubber. The synthetic rubber latices may comprise copolymers of butadiene and styrene usually containing 50%–70% by weight butadiene. The NBR rubbers, copolymers of butadiene and acrylonitrile may also be used. Polychloroprenes, which are polymers of 2-chlorobutadiene-1,3, may be used and are preferred because they maintain the needed fire resistance in the preferred product. Many of these basic copolymeric latices are modified by the addition of a third copolymerizable ingredient to impart special properties to the synthetic rubber binder. The chosen synthetic rubber latex is simply added with agitation to the pretreated fibrous slurry containing the dispersed chlorinated natural rubber. Since the fibers have been pretreated for beater saturation, agitation will usually suffice to precipitate the binder onto the fibers. As the synthetic rubber particles from the latex precipitate onto the fibers, the particles carry with them the particles of the chlorinated natural rubber. The sticky nature of the synthetic latex binder aids in holding the powdered chlorinated natural rubber onto the fibers. If necessary or desirable, additional precipitating agents may be added to the slurry after the addition of the synthetic rubber latex in order to complete the precipitation.

The amount of synthetic rubber latex binder to be added will generally be in the range of 3%–50% by weight rubber binder based on the dry weight of the fibers. For the primary purpose of the present invention of making fill for cooling towers, it is preferred to add 10%–20% by weight of the synthetic rubber latex binder.

Once the binder has deposited on the fibers carrying with it the chlorinated natural rubber particles, a suitable sheet may be formed from the resulting slurry. The sheet may be formed in any of the conventional methods in the papermaking art. A sheet mold may be used, as may a fourdrinier wire or a cylinder machine. In the making of cooling tower fill, the sheet will preferably have a thickness in the range of about 0.012–0.080 inch. The water will be drained from the web, and the web will be dried in the usual manner. Drying will be carried out normally; moisture will be present in the sheet in the amount of about 2%–5% by weight. If the sheet at this stage is stored, it will normally reach equilibrium as to moisture content depending on ambient conditions. In this condition, the sheet will normally be open, that is, liquids may readily penetrate into the interior of the sheet. To this end, calendering or other pressing of the wet web or the dry sheet is normally to be avoided.

The next step in the present process is to immerse or otherwise treat the dry sheet with a solvent for the chlorinated natural rubber, the solvent not being capable of severely swelling the synthetic rubber binder in order that the sheet be able to hold together under the action of the solvent on the sheet. Where neoprene and the NBR rubbers are used as binder, toluene will be the solvent of choice. However, other solvents such as benzene, chlorinated aromatic solvents, chlorinated aliphatic solvents, and other aliphatic and aromatic solvents may be used provided they leave the synthetic rubber binder substantially nondissolved or only slightly swollen in order to preserve sheet integrity during the solvent treatment step. The dried sheet is conveniently treated with a solvent by passing the dried sheet on rollers into or through a bath of the solvent, followed by removal of the solvent-soaked sheet from the bath. As the sheet emerges from the bath, it may pass between rollers to press excess solvent from the sheet. It is to withstand such handling that the solvent must be one in which the chlorinated natural rubber is easily swellable and the rubber binder is difficultly swellable. As a general guide, an easily swellable rubber is one whose volume increases at least about 40% under the action of the solvent, and often the volume increase will be 100% or more. A difficultly swellable rubber is one whose volume increases no more than a maximum of about 20%.

The sheet must be in the solvent bath sufficiently long for the solvent to smear the chlorinated natural rubber throughout the sheet and to fuse the individual chlorinated natural rubber particles in the sheet into a stiffer coherent mass. The sheet should not be immersed in the bath sufficiently long that the chlorinated natural rubber is dissolved away completely. There will always be a certain small amount of loss of the chlorinated natural rubber in the solvent pressed from the sheet, and to minimize such loss, it is preferred that the sheet be immersed in the bath for a period of time sufficient for the solvent to spread around and smear the chlorinated natural rubber but insufficient to carry a significant amount of the natural rubber away. Penetration of the solvent into the sheet is immediate due to the open nature of the sheet, and solvation starts immediately. The time of immersion of the sheet in the solvent will depend to some extent on the thickness of the sheet, on the exact solvent used, and on the amount of chlorinated natural rubber on the fibers. For sheets having the thickness described earlier, it has been found that a period of time of immersion of 2 to 60 seconds will suffice to smear out the chlorinated natural rubber without undue loss. The goal of the immersion step is simply to smear and fuse the chlorinated natural rubber throughout the fibers in the sheet without significantly disturbing the normal binding properties of the synthetic rubber binder. Room temperature conditions will normally be used in the immersion step, although slightly elevated temperatures may reduce the time of immersion if such is desired.

After passing through any squeeze rolls on emergence from the bath, the sheet is dried to remove the solvent. This may be carried out in any convenient manner, due care being given to any flammability and inhalation hazards of the volatile solvent. Elevated temperatures will normally be used in solvent removal. A convenient way to remove the solvent will be in a forced hot air oven maintained at about 195° F. for a period of time of about 2 minutes. The synthetic binder particles maintain their function as a binder for the fibers substantially unchanged throughout the entire process.

The resulting sheet will be stiff and boardlike, and in the preferred embodiments of the present invention, extremely fire resistant. The sheet lends itself to molding under a variety of conditions into various configurations, particularly into corrugated forms and other shapes used as fill for towers in order to greatly increase the area of contact between a liquid and a gas such as air. Such molding processes are known and are normally carried out at a temperature in the range of 400°–475° F. The products made by the process of the present invention are advantageous in their adaptability to be formed into various shapes, their fire resistance, their resistance to deterioration under the constant flow of water and the impingement of high velocity air, and their ability to retain their shape.

The following examples illustrate several embodiments of the invention. All parts are by weight unless otherwise stated.

EXAMPLE 1

The following two formulations were prepared:

| Ingredients | Parts I | Parts II |
|---|---|---|
| Asbestos | 27.2 | 27.2 |
| Antioxidant (condensation product of symmetrical dibetanaphthol-para-phenylene diamine) | 0.09 | 0.09 |
| Pigment (carbon black) | 0.403 | 0.403 |
| Water | 1,420 | 1,420 |
| Chlorinated natural rubber (Parlon S-10) | 6.8 | 6.8 |
| Neoprene LD-450 (chloroprene plus acrylonitrile copolymer) | 7.180 | — |
| Geon 660X4 (vinylidene chloride-acrylic copolymer) | — | 7.2 |

The asbestos was added to the water with agitation and the powdered chlorinated natural rubber was next added. No special pretreatment steps were required. The synthetic rubber latex binder (Neoprene LD-450) was next added; the amount is 11% by weight based on the weight of the fibers. The binder particles precipitated on the asbestos fibers over a period of 1 to 2 minutes, carrying with them all of the dispersed powdered chlorinated rubber in the slurry.

When the water cleared showing that precipitation was complete, the rubber-coated fibers in water were poured into a small sheet mold and drained. the web was then gently pressed to remove additional water and was dried in an oven.

The dried sheet was dipped in toluene for 10 seconds. On removal from the toluene bath, the sheet was placed in a forced air circulating oven for several minutes until dry.

The resulting sheet was stiff, boardlike, and could readily be formed into a corrugated cooling water tower fill having good fire resistance and performing satisfactorily under tower conditions.

EXAMPLE 2

A hand sheet was made and dried in the usual manner utilizing the following ingredients:

| Ingredients | Parts |
|---|---|
| Asbestos | 27.2 |
| Water | 1420 |
| Chlorinated natural rubber (Parlon S-10) | 6.8 |
| Acrylic latex (Hycar 2671) | 5.65 |

After drying, five strips measuring about 1 inch by 5 inches were cut from the dried sheet. Each strip was separately immersed in five different solvents. The solvents used were methyl ethyl ketone, acetone, benzene, toluol, and xylol. The five strips exhibited differing degrees of stiffness, the stiffer strips indicating more complete solvent action and smearing of the chlorinated natural rubber as it was distributed throughout the sheet. Based on simple handling of the sheets, in decreasing order of stiffness, the solvent action was best in toluene, then xylene, then methyl ethyl ketone, then acetone, then benzene. All strips were noticeably stiffened, however, thus demonstrating the smearing of the chlorinated natural rubber.

What is claimed is:

1. A beater saturation process which comprises a. forming a slurry of fibers in water;

b. adding powdered chlorinated natural rubber particles to the slurry in an amount of about 25% by weight based on the dry weight of the fibers;

c. adding a synthetic latex binder, the binding properties of which will remain substantially unchanged by subsequently applied solvent for the chlorinated rubber particles;

d. precipitating said binder onto said fibers whereby said powdered rubber is carried with said binder to said fibers;

e. forming sheet from the rubber coated fibers;

f. drying the sheet;

g. treating the dried sheet with a solvent for the chlorinated rubber particles for a period of time sufficient to cause substantial swelling and smearing of the rubber particles throughout the fibers of the sheet without causing any significant swelling of the binder; and h. removing the solvent.

2. The process according to claim 1 wherein the rubber particles are swollen to an increased volume of at least 40%.

3. The process according to claim 1 wherein the synthetic latex binder is added in the range of about 3%–50% by weight of the rubber binder based on the dry weight of the fibers.

4. The process according to claim 1 wherein the sheet has a thickness in the range of about 0.012–0.080 inch, the synthetic latex binder is added in the range of 10%–20% by weight of the rubber binder based on the dry weight of the fibers and, the dried sheet is treated with the solvent for a period of time in the range of 2–60 seconds.

5. The process according to claim 1 in which said fibers comprise asbestos.

6. The process according to claim 1 wherein said synthetic rubber latex comprises a polychloroprene.

7. The process according to claim 1 wherein the particle size of said powdered chlorinated natural rubber particles may be defined as at least 95% passing a No. 20 sieve, 40% to 90% passing a No. 180 sieve, and 40% passing a No. 325 sieve.

8. The process according to claim 1 wherein said solvent is toluene.

9. The product made according to the process of claim 1.

* * * * *